US005536535A

United States Patent [19]

Yamazaki et al.

[11] Patent Number: 5,536,535

[45] Date of Patent: Jul. 16, 1996

[54] PROCESS FOR PRODUCING A COATED PAPER

[75] Inventors: Yoichi Yamazaki; Hirotoshi Aikawa; Kazuaki Kamata; Yasunori Nanri, all of Tokyo, Japan

[73] Assignee: Nippon Paper Industries Co., Ltd., Tokyo, Japan

[21] Appl. No.: 400,873

[22] Filed: Mar. 8, 1995

[30] Foreign Application Priority Data

Mar. 9, 1994 [JP] Japan ..... 6-064426

[51] Int. Cl.[6] ..... B05D 3/04

[52] U.S. Cl. ..... 427/378; 427/377; 427/391; 162/136; 162/207

[58] Field of Search ..... 162/136, 207; 427/377, 378, 391

[56] References Cited

U.S. PATENT DOCUMENTS

| | | | |
|---|---|---|---|
| 4,043,049 | 8/1977 | Hedstrom | 34/10 |
| 4,242,808 | 1/1981 | Luthi | 162/207 |
| 4,244,778 | 1/1981 | Lindahl et al. | 162/17 |
| 4,355,081 | 10/1982 | Kinsley, Jr. | 428/526 |
| 4,765,067 | 8/1988 | Taylor | 162/207 |
| 4,828,650 | 5/1989 | Wagle et al. | 162/168.1 |
| 4,919,758 | 4/1990 | Wagle et al. | 162/207 |
| 5,384,011 | 1/1995 | Hazard, Jr. | 162/9 |

OTHER PUBLICATIONS

Abstract of JP 06–235197, Aug. 1994.
Abstract of JP 06–073694, Mar. 1994.
Abstract of JP 02–160993, Jun. 1990.
Abstract of DE 2726222, Dec. 1978.

*Primary Examiner*—Shrive Beck
*Assistant Examiner*—Erma Cameron
*Attorney, Agent, or Firm*—Oblon, Spivak, McClelland, Maier & Neustadt

[57] ABSTRACT

A process for producing coated paper comprises applying an aqueous coating solution onto coating base paper and drying the coating base paper, wherein a steam provided for drying or gas composed mainly of a steam is brought into direct contact with paper sheet, heated for regeneration, and then circulation for re-use, in which owing to the improvements in the heat efficiency and drying rate in the drying step, not only the productivity is improved, but also a high-quality coated paper is stably produced with a good efficiency.

4 Claims, 4 Drawing Sheets

PROCESS FOR PRODUCING A COATED PAPER

FIELD OF THE INVENTION

The present invention relates to a process for producing coated paper. More particularly, the present invention is directed to drying of coated paper by using superheated steam.

BACKGROUND OF THE INVENTION

The development of the production technology of coated paper is remarkable. Hitherto, the principal object of the technology has been rather to develop the coating step. However, in recent years, following an increase in the coating rate, an attention has also been paid to the drying step from the point of view of needs of an increase in the drying rate as well as of improvements in the quality, and IR dryers, flotation dryers and so on, have been developed.

Coated papers are produced by coating paper with coating solution comprising substances or chemicals for the purposes of imparting new physical properties or functions and then drying it. Typical examples of them include clay-coated paper, a pressure-sensitive recording paper, and a thermo-sensitive recording paper. The coating as referred to herein includes not only mere surface coating of paper but also impregnation of chemical solution into the paper layer. In the drying method which has hitherto been used for these coated papers, heated air is used as a drying heat source and brought into direct contact with paper sheet in a drying chamber, and the heated air provided for drying is discharged out from the drying chamber as waste gas together with water vapor evaporated from the paper sheet. However, in this method, since the heated air has no condensation latent heat, its heat capacity is relatively small so that a considerable period of time is required for warming up the paper to the adiabatic saturation temperature. Although the heated air provided for drying contains the evaporated water vapor and has high heat energy, it is limited in terms of the recovery and circulation for re-use and hence, is discarded in many cases. For this reason, the heat efficiency in this drying method is low.

Drying of a substance by using superheated steam has already been employed in the mining and food fields, and also, the drying paper by using superheated steam is not a novel means in the paper manufacture field. So far, it has been reported in the literatures to apply this drying method for drying a wet hand-sheet made up by using a hand sheet machine and to compare with the usual drying. However, no practical method of drying by using superheated steam has been disclosed. In particular, there is no report directed to the application for coated papers. The reasons for this are that the qualities of paper produced by using high-temperature superheated steam and advantages of the heat efficiency have not been clarified yet and that the proportion of the air to the steam in the heating medium has been liable to change. From the standpoint of practical use, there is a fear about instabilization in the product quality and productivity.

In recent years, following an increase in the coating rate owing to the improvement in-productivity, there has been a problem in shortage of the drying ability. However, for the conventional drying method of coated paper, while it is possible to improve the drying ability by increasing the adiabatic saturation temperature, there is still a great problem in terms of the heat efficiency as described above. On the other hand, because of an innovation in the printing technology as well as of a development in OA instruments, in particular, an increase in the speed and an improvement in the image quality of printing machines and printers,the present products of these coated papers are not always satisfactory in terms of mottling at the time of color printing on a coated printing paper (color shading at the time of multi-color printing), stiffness, dimensional stability (including anti-curl properties), ink absorbency, and so on.

From these standpoints of view, the present inventors have made extensive investigations about a quite new process for drying coated paper, which is free from the conventional concept, and attempted to improve the heat efficiency in the drying as well as the quality of coated paper, both of which have been considered to be of problem.

SUMMARY OF THE INVENTION

An object of the present invention is to provide a process for producing coated paper in applying aqueous coating solution onto base paper and drying thereof, wherein steam provided for drying or gas composed mainly of steam is brought into direct contact with paper sheets, heated for regeneration, and then circulated for re-use.

BRIEF DESCRIPTION OF THE ACCOMPANIED DRAWINGS

DETAILED DESCRIPTION OF THE INVENTION

Figure 1:
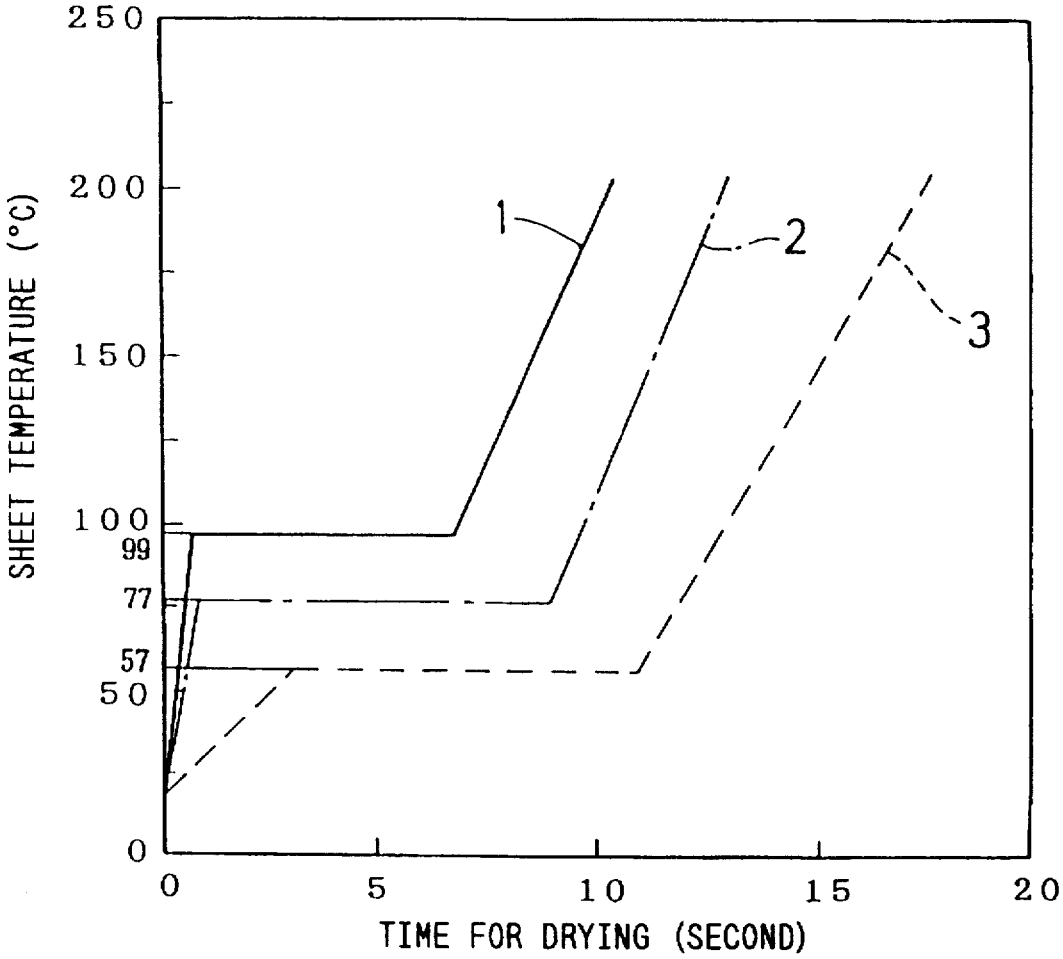
FIG. 1 is a drawing to show the change in sheet temperature with time lapse for each of drying gases.

FIG. 1 is a drawing to show the change of sheet temperature at the heating time with time lapse examined by using each of superheated steam 1, mixed gas 2 of superheated steam and heated air, and heated air 3, each of which is heated at a temperature of 280° C. The sheet temperature was measured by sandwiching sheet-type thermocouple in coating base papers. The change of the drying step is mentioned below with reference to FIG. 1. In any cases, the drying step is roughly classified into three stages; first stage is a initial drying period for warming a substance to be dried to the adiabatic saturation temperature (the wet-bulb temperature corresponding to the gas for drying); the second stage is a constant-rate drying period in which evaporation rate as well as the adiabatic saturation temperature is constant; and the third stage is a falling-rate drying period in which sheet temperatures of the substance increases rapidly to reach the heating temperature (in the vicinity of the drying medium temperature).

Furthermore, the drying steps in the present invention are described below with reference to each of the drying stages. Paper sheet comprising base paper having an aqueous coating solution applied is fed in a state containing a large amount of moisture to the drying step. A heat source for drying which is used in the present invention is superheated steam or gas composed mainly of superheated steam, and when it is brought into contact with the paper sheet at a low temperature in the, drying chamber, a part of the superheated steam is condensed on the paper sheet to become liquid. The temperature of the paper sheet rapidly increases owing to a large amount of condensation latent heat emitted herein and reaches the adiabatic saturation temperature within short period of time, whereby the paper sheet is in the constant-rate drying period. In this period, the adiabatic saturation temperature is not only constant but also approximately equal to the wet-bulb temperature in relation to the partial pressure of water vapor of the gas for heating. The paper sheet which has reached the adiabatic saturation temperature is gradually given with sensible heat of the superheated steam to evaporate the moisture. When the paper sheet exceeds the constant-rate drying period (exceeds the critical water content), the sheet temperature gradually increases, and evaporation rate is reduced, whereby the paper sheet has a desired water content and comes out from the drying chamber.

As is clear from FIG. 1, one of the features of the present invention resides in that the pre-heating time or preheating period is extremely short as compared with the conventionally employed drying technology by using heated air. In addition, when the drying by heated air is compared with the drying by superheated steam at the same temperature, the rate of drying by the heated air is higher than that of drying by the superheated steam at lower heating temperature, but at higher heating temperature the rate of drying by the superheated steam becomes higher than that of drying by the heated air because in such a drying process the heat transfer coefficient of the gas which is a characteristic, the heat transfer coefficient of the superheated steam being higher than that of the heated air, gets more dominant than a difference between a temperature of the gas and a drying temperature and the drying rate by the superheated steam becomes higher and therefore advantageous. Accordingly, it can be understood that the drying rate increased with an increase of superheating temperature. This is another feature of the present invention. Thus, by using the present invention, the producibility can be increased in the existing facilities (an increase of the coating rate), and when the facilities are newly designed, the drying parts can be shortened so as to realize the space-saving. Next, since the drying medium is the same as the evaporated gas, not only the recovery and reuse of the gas are easy from the standpoints of facilities and quality control, but also the heat efficiency is high, so that the present invention is advantageous from the stanpoint of production cost. Moreover, the present inventors made extensive investigations about various drying modes. Then, it has been found that the coated paper obtained in the present invention provides good results with respect to the quality, especially improvements in the air permeability, ink absorbency, mottling and so on.

The reason for these are not always clear at present. Since the expansion of the moisture, as well as the evaporation of the moisture take place in the interior of drying substances owing to a rapid increase of the paper temperature, the density of the drying becomes rougher than that before heating, leading to make the coating layer porous, whereby the air permeability and ink absorbency are improved.

The production process of the present invention is now described below with reference to FIG. 2. A coating base paper 5 drawn out from an unwinder 4 is coated with aqueous coating solution by using a blade coater 6 and then fed into a drying chamber 7 comprising a box-type hot-air dryer. The coating chamber used in the present invention is not limited to the blade coater but also includes air-knife coaters, roll coaters, bar coaters, curtain coaters, gravure coaters, impregnation chamber, etc. The drying chamber 7 is not limited to the box-type hot-air dryer, but any other drying chamber can also be used without particular limitations so far as they can meet the object of the present invention, especially the circulation for re-use of the drying gas. Furthermore, the portion to be used in the present invention is not limited to the whole zone of the drying step only, but combination with the conventional drying methods can also be employed without particular limitations. In the drying chamber, the paper sheet containing a large amount of moisture by the coating is dried by superheated steam in the drying chamber 7 through the route as shown in FIG. 1 and wound up by a reel 8 while controlling the desired moisture content.

Figure 3:
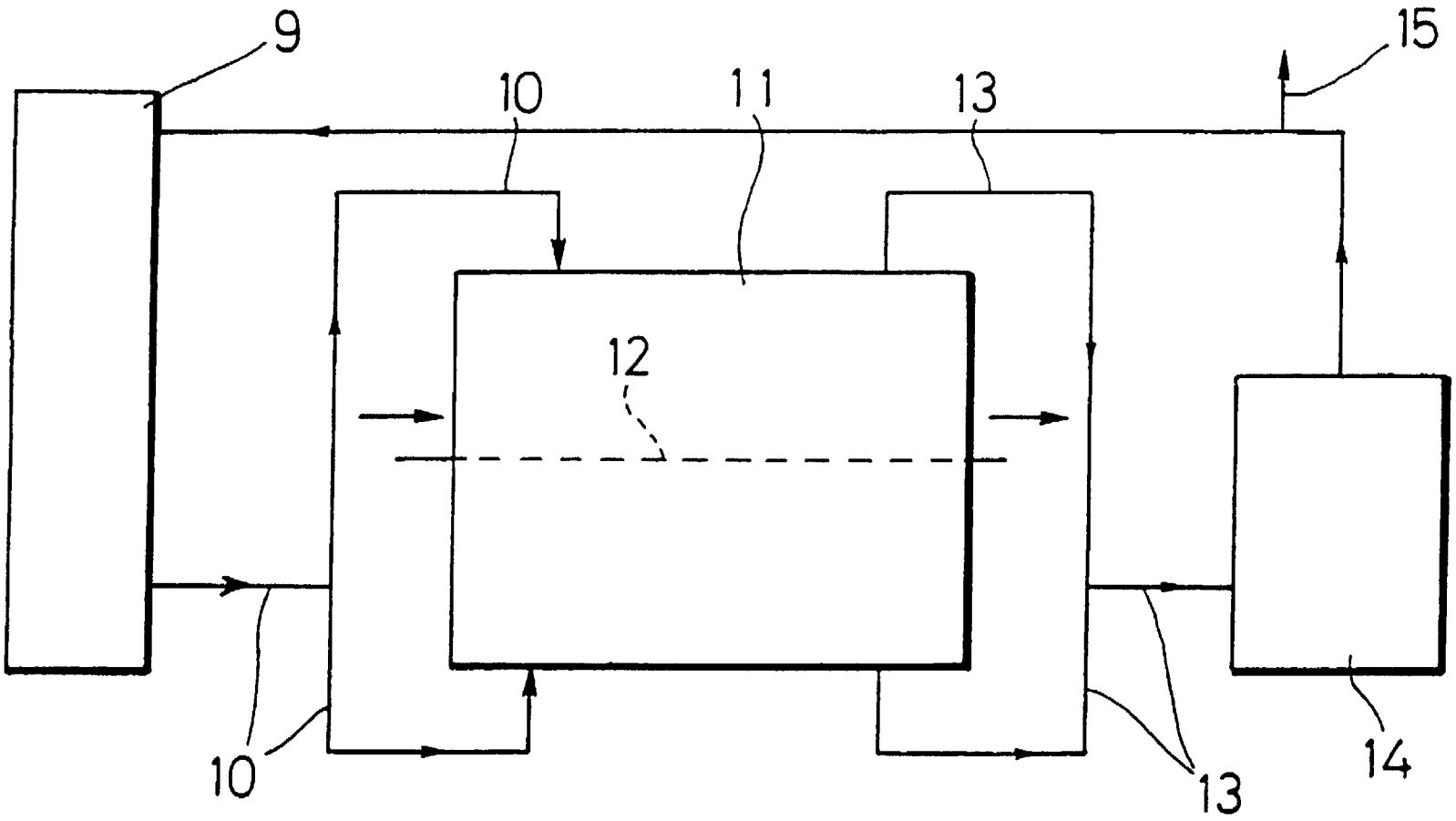
FIG. 3 is a drawing to show a drying system of superheated steam.

FIG. 3 shows a flow of the regeneration and circulation of a steam for heating. A high-temperature superheated steam 10 heated by a superheater 9 is fed into a drying chamber 11 and provided for drying while bringing into direct contact with paper sheet 12. The paper sheet 12 imparted with an energy from the high-temperature superheated steam 10 is gradually dried while evaporating the moisture and when it has a desired moisture content, comes out from the drying chamber 11. A low-temperature steam 13, the temperature of which has decreased by imparting an energy and which contains a newly evaporated steam, is introduced into the superheater 9 through a blower 14, superheated to a desired temperature, recovered for regeneration, and then provided to dry the paper sheet 12. In this case, since the amount of the recovered gas increases corresponding to the amount of the steam evaporated from the paper sheet, the increased amount of the gas is discharged out from a discharge outlet 15 and used for other applications, so that a constant amount of the gas is always circulated.

As the heat source for heating in the superheater, any heat sources capable of superheating to a desired temperature, such as heavy oils, light oils, natural gases, and electricity, can be used without particular limitations. In accordance with the conventional drying mainly by hot air, since water vapor evaporated upon drying is mingled, when the recovered gas is circulation for re-use, the proportion of the air to the water vapor changes so that the adiabatic saturation temperature changes to cause changes in the drying rate and product quality, resulting in making the operation difficult. Also, troubles are liable to occur due to the condensation in the interior or inlet and outlet of the drying chamber. For this reason, the partial pressure of water vapor must be reduced by blowing dry air (fresh air) for hot air drying. In addition, since it is difficult to recover the evaporation latent heat from the drying medium having a low partial pressure of water vapor so that the evaporation latent heat of the water vapor can not be recovered, the value as an energy decreases. For this reason, the air provided for drying is presently discarded into the atmosphere.

The heating gas used in the present invention is superheated steam alone or is composed mainly of superheated steam, the wet-bulb temperature of which is preferably from 85° to 110° C. If the temperature is 85° C. or lower, the partial pressure of water vapor of the drying gas is so low that the difference from the atmospheric pressure becomes great, the amount of the air mingled in the drying chamber increases, and the efficiency of heat recovery from the waste gas is reduced. In order to avoid these problems, there is a method in which the drying chamber is in a closed state to increase the vacuum degree. However, in this method, the burden with respect to the facilities remarkably increases, and hence, this method is not practical for use. Also, as shown in the following Examples, if the adiabatic saturation temperature in the constant-rate drying stage decreases, the effects of the present invention from the standpoint of quality become lower. On the other hand, if the temperature exceeds 110° C., the partial pressure of water vapor increases so that the whole pressure of the drying gas becomes too high, the leakage of the gas from the drying chamber is liable to occur, and it is difficult to stably achieve the operation. Thus, an attention must be paid.

In addition, the temperature of the gas of the present invention is preferably from 150° to 500° C. If the temperature exceeds 500° C., it is difficult to control the degree of drying, and there is a possibility that the paper is rapidly excessively dried in the falling-rate drying stage to likely cause a reduction in the paper quality such as discoloration and cornification. On the other hand, if the temperature is 150° C. or lower, the drying rate is inferior to that by heated air due to a low degree of superheating, and the capacity as the heat source is low. Moreover, the gas is cooled and condensed by the surrounding wall of the drying chamber, whereby water droplets likely fall down on the paper sheet from the ceiling to cause paper breakage.

As the coating base paper used in the present invention, any conventionally employed base papers for coating, such as fine papers, mechanical papers, news print paper or medium-gloss papers, kraft papers, glassine papers, and paperboards, can be used. Next, as the aqueous coating solution used in the present invention, judging from the character of the present invention, any coating solutions can be used without particular limitations so far as the coating composition to be coated on paper contains water as a medium, such as aqueous solutions or aqueous suspensions, in which the substance for evaporation by heating is water, and does not contain substantial amounts of other volatile substances such as organic solvents. Examples thereof include coating solutions for clay-coating composed mainly of pigments and binders, coating solutions for pressure-sensitive recording papers containing binders and color developers or color formers, coating solutions for thermo-sensitive recording papers composed mainly of color formers, color developers, and binders, coating solutions for ink-jet recording containing chemicals capable of imparting water resistance and water absorption and binders, and impregnation solutions for impregnated papers capable of imparting special functions such as flame retardance.

In the process for producing coated paper according to the present invention, since an aqueous coating solution is applied onto coating base paper, which is then dried by using superheated steam alone or gas composed mainly of superheated steam, the composition of the drying gas does not substantially change even after the circulation for re-use. The fact that the heating medium is the same as the evaporated gas not only makes the recovery and regeneration easy but also makes the constant-rate adiabatic saturation temperature constant even after the circulation for re-use over a long period of time. In addition, since drying gas is superheated steam, and its condensation latent heat is used in the preheating drying, whereas its sensible heat is used in the evaporation of moisture, the time of the preheating drying is shortened, and the constant-rate adiabatic saturation temperature is increased. Thus, a high-quality coated paper can be stably produced with a good efficiency. Moreover, when the present invention is carried out at a wet-bulb temperature of from 85° to 110° C. and at a heating temperature of from 150° to 500° C., good qualities which are free from any fear of reduction in whiteness as well as from any deterioration in mottling, can be found.

The present invention is described in more detail with reference to the following Examples, but it should not be construed that the invention is limited thereto.

EXAMPLES 1, 2, 3, AND COMPARATIVE EXAMPLES 1, 2 AND 3

Figure 2:
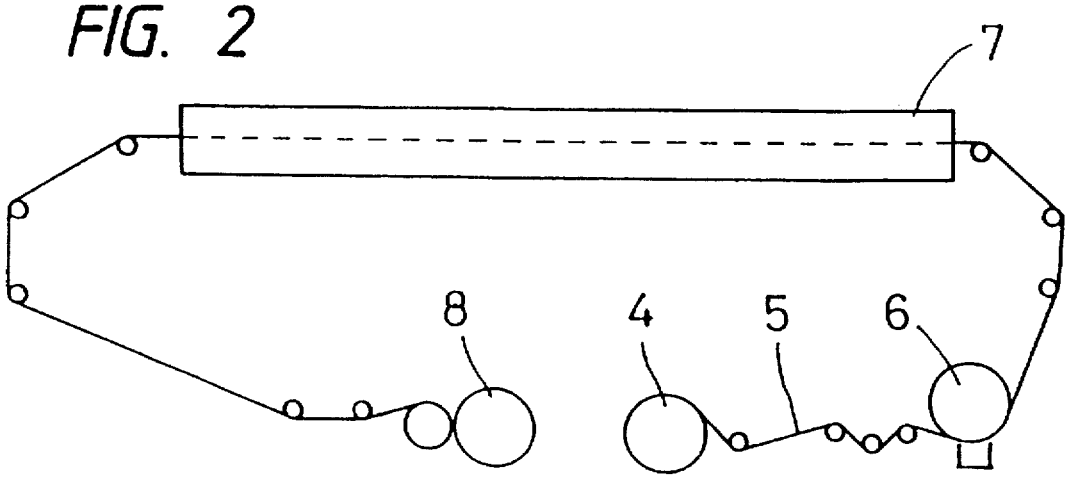
FIG. 2 is a drawing to show a coater.

By using a blade coater as shown in FIG. 2, one surface of a coating base paper for coated paper (81 g/m$^2$) was coated with a coating solution having a formulation as described below and a solids content of 60% so as to have a coating weight of 13 g/m$^2$ after drying, dried by using, as heated gas for drying, superheated steam at a temperature of 210° C., 280° C. or 420° C. and at a wet-bulb temperature of 99° C., or an air at a temperature of 140° C., 210° C. or 280° C. and at a wet-bulb temperature of from 50° to 57° C., and then subjected to super-calendering processing, to thereby produce coated papers (Examples 1, 2 and 3, and Comparative Examples 1, 2 and 3, respectively). The analysis results of the quality as well as the evaporation rate with respect to each of the coated papers are shown in Table 1. In the case that the heating temperature is identical, the Examples according to the present invention were superior in the density, air permeability, ink absorbency, and mottling and high in the evaporation rate as compared with the Comparative Examples. Also, in the Examples according to the present invention, no curl was observed after the coating. On the other hand, there were no substantial differences therebetween in terms of the whiteness, white paper gloss, and IGT strength.

[Composition of coating solution]

| | Weight Parts |
|---|---|
| Calcium carbonate (Carbital 90, a trade name of E.C.C., Japan) | 40 |
| Kaolin (UW-90, a trade name of Ryosan Shoji Co., Ltd.) | 60 |
| Latex (JSR-0668, a trade name of Japan Synthetic Rubber Co., Ltd.) | 10 |
| Starch (Oji Ace A, a trade name of Oji Corn Starch Co., Ltd.) | 2 |

TABLE 1

| | Example No. | | |
|---|---|---|---|
| | 1 | 2 | 3 |
| Kind of gas for drying | Superheated steam | | |
| Heating temperature (°C.) | 210 | 280 | 420 |
| Wet-bulb temperature (°C.) | 99 | 99 | 99 |
| Density (g/cm$^3$) | 1.12 | 1.10 | 1.08 |
| Whiteness (%) | 80.7 | 80.4 | 80.2 |
| Paper gloss (%) | 62.4 | 62.0 | 61.7 |
| Smoothness (sec) | 2000 | 2000 | 1900 |
| Air permeability (sec) | 3100 | 3000 | 2800 |
| Ink absorbency (ΔBN %) | 18.5 | 18.0 | 17.0 |
| IGT (cm/s) | 140 | 140 | 130 |
| Mottling | Good | Good | Good |
| Curl properties | Good | Good | Good |
| Evaporation rate (kg/m$^2$ · hr) | 40 | 60 | 100 |
| | **Comparative Example No.** | | |
| | 1 | 2 | 3 |
| Kind of gas for drying | Heated air | | |
| Heating temperature (°C.) | 140 | 210 | 280 |
| Wet-bulb temperature (°C.) | 50 | 54 | 57 |
| Density (g/cm$^3$) | 1.15 | 1.15 | 1.14 |
| Whiteness (%) | 80.4 | 80.6 | 80.1 |
| Paper gloss (%) | 62.6 | 62.0 | 61.8 |
| Smoothness (sec) | 2150 | 2100 | 2100 |
| Air permeability (sec) | 3400 | 3400 | 3400 |

TABLE 1-continued

| | | | |
|---|---|---|---|
| Ink absorbency (ΔBN %) | 21.5 | 22.0 | 22.9 |
| IGT (cm/s) | 130 | 130 | 140 |
| Mottling | Fair | Bad | Bad |
| Curl properties | Bad | Bad | Bad |
| Evaporation rate (kg/m$^2$ · hr) | 15 | 30 | 50 |

EXAMPLES 4 AND 5, AND COMPARATIVE EXAMPLES 4 AND 5

By using the same coater as in Example 1, one surface of coating base paper for coated paper (81 g/m$^2$) was coated with a coating solution having a formulation as described below and a solids content of 60% so as to have a coating weight of 18 g/m$^2$ after drying, dried by using, as a heated gas for drying, superheated steam at a temperature of 280° C. or 420° C. and at a wet-bulb temperature of 99° C., or an air at a temperature of 140° C. or 280° C. and at a wet-bulb temperature of from 50° to 57° C., and then subjected to super-calendering processing, to thereby produce coated papers (Examples 4 and 5, and Comparative Examples 4 and 5, respectively). The analysis results of the quality as well as the evaporation rate with respect to each of the coated papers are shown in Table 2. The same results as in Examples 1, 2 and 3 are obtained. Especially, the Examples according to the present invention were superior in the air permeability and ink absorbency.

| [Composition of coating solution] | Weight Parts |
|---|---|
| Calcium carbonate (Eskalon #2000, a trade name of Sankyo Seifun Co., Ltd.) | 20 |
| Kaolin (UW-90, a trade name of Ryosan Shoji Co., Ltd.) | 70 |
| Satin white (SW-BL, a trade name of Shiraishi Kogyo Co., Ltd.) | 10 |
| Latex (JSR-0668, a trade name of Japan Synthetic Rubber Co., Ltd.) | 15 |
| Starch (Oji Ace A, a trade name of Oji Corn Starch Co., Ltd.) | 5 |

TABLE 2

| | Example No. | | Comparative Example No. | |
|---|---|---|---|---|
| | 4 | 5 | 4 | 5 |
| Kind of gas for drying | Superheated steam | | Heated air | |
| Heating temperature (°C.) | 280 | 420 | 140 | 280 |
| Wet-bulb temperature (°C.) | 99 | 99 | 50 | 57 |
| Density (g/cm$^3$) | 1.14 | 1.12 | 1.18 | 1.17 |
| Whiteness (%) | 80.8 | 80.3 | 79.5 | 79.6 |
| Paper gloss (%) | 78.3 | 78.0 | 79.9 | 79.5 |
| Smoothness (sec) | 3400 | 3200 | 3700 | 3700 |
| Air permeability (sec) | 3600 | 3400 | 4900 | 4900 |
| Ink absorbency (ΔBN %) | 26.1 | 23.5 | 41.3 | 41.6 |
| IGT (cm/s) | 60 | 150 | 150 | 160 |
| Mottling | Good | Good | Fair | Bad |
| Curl properties | Good | Good | Bad | Bad |
| Evaporation rate (kg/m$^2$ · hr) | 60 | 100 | 15 | 50 |

EXAMPLES 6 AND 7, AND COMPARATIVE EXAMPLES 6 AND 7

Figure 4:
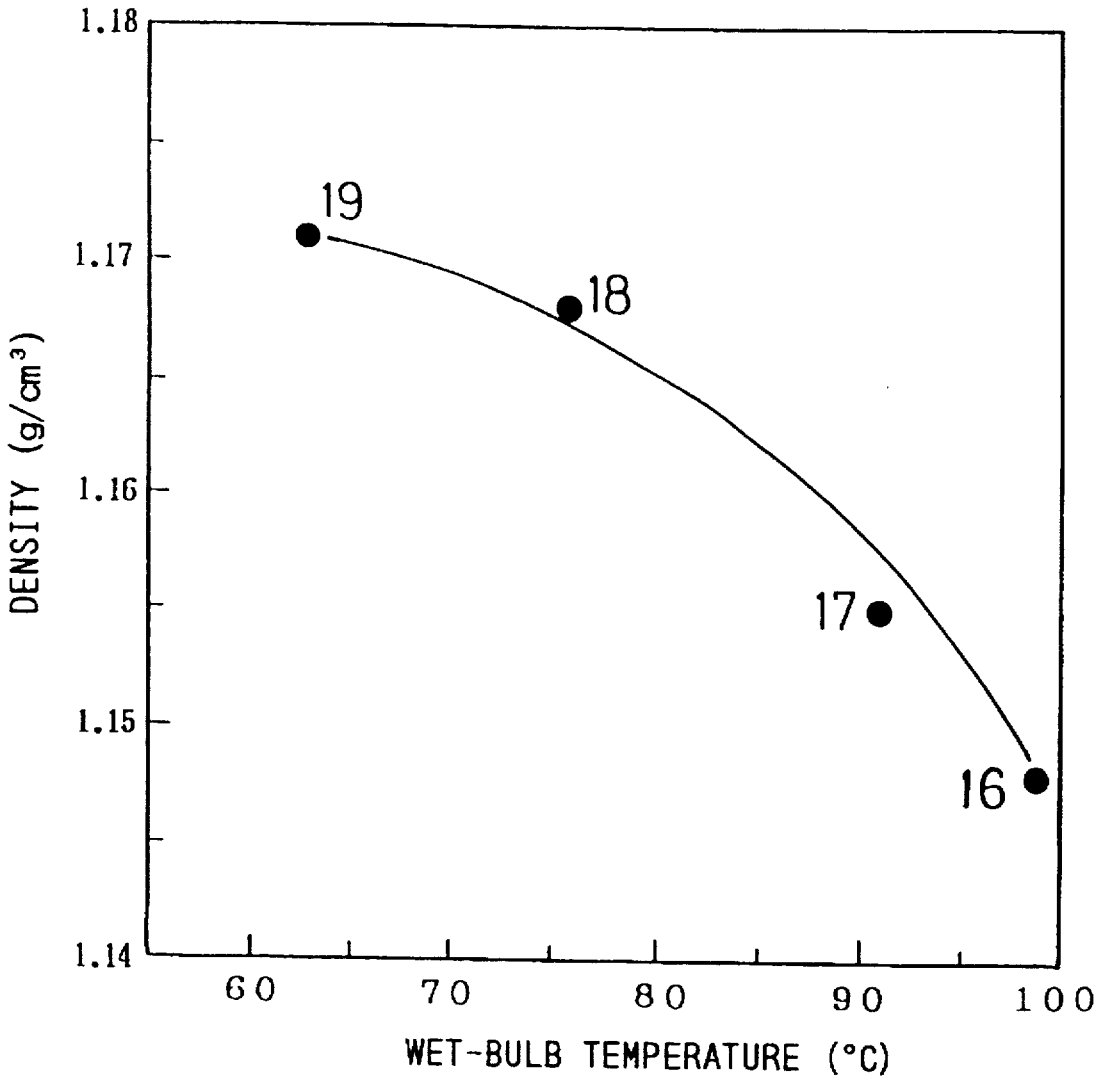
FIG. 4 is a drawing to show the change of density with the change of wet-bulb temperature.
Figure 5:
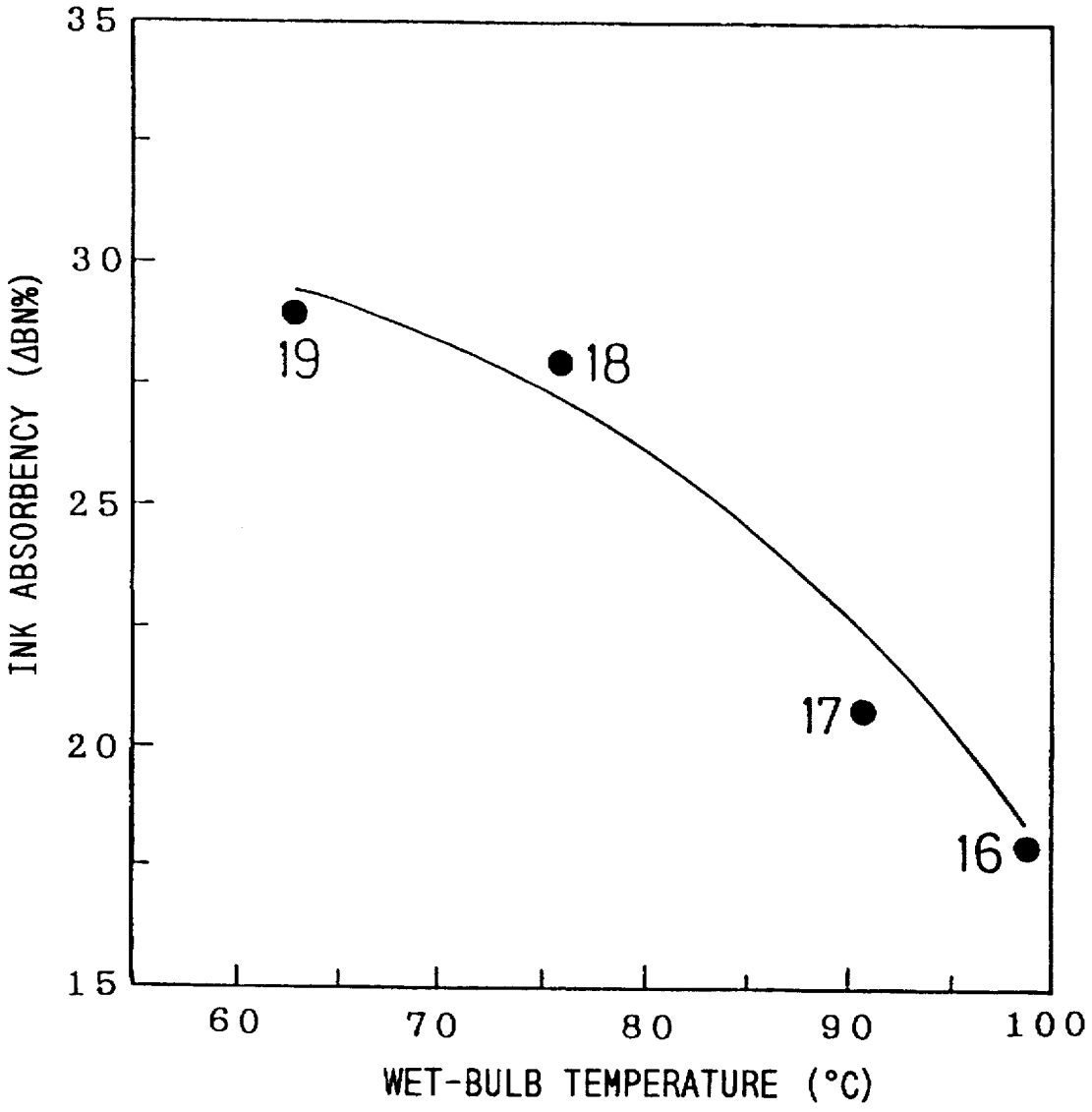
FIG. 5 is a drawing to show the change of ink absorbency with the change of wet-bulb temperature.

Coated papers having a coating weight of 20 g/m$^2$ were produced in the same manner as in Examples 1, 2 and 3, except for using steam at a superheating temperature of 280° C. and mixing air therewith so as to change the partial pressure of steam to thereby control the wet-bulb temperature at 63° C., 76° C., 91° C., or 99° C. (Comparative Examples 6 and 7, and Examples 6 and 7, respectively), and the density and ink absorbency of each of the coated papers were examined. The results obtained are shown in FIGS. 4 and 5. In FIGS. 4 and 5, numerals 16, 17, 18, and 19 show Example 6, Example 7, Comparative Example 6, and Comparative Example 7, respectively.

As is clear from these drawings, the density of the coated paper decreased, and the ink absorbency were improved with an increase of the wet-bulb temperature of the superheated steam.

[Evaluation method of the quality]

(1) Density:

The density was obtained by dividing the basis weight (JIS P 8124) by the thickness according to JIS P 8118.

(2) Whiteness:

The whiteness was measured according to JIS P 8123.

(3) Paper gloss:

The paper gloss was obtained by measuring the specular gloss at 75° according to JIS P 8142.

(4) Smoothness:

The smoothness was measured by means of an Ohken-type smoothness meter according to JAPAN TAPPI No. 5.

(5) Air permeability rate:

The air permeability rate was measured by means of an Ohken-type air permeability rate meter according to JAPAN TAPPI No. 5.

(6) IGT:

The IGT was measured by means of an IGT printability tester according to JIS P 8129.

(7) Ink absorbency:

On a surface coated with a coating solution was printed 0.8 cc of a New GLS black ink made by Sakata Ink K. K. by means of an RI tester made by Akira Seisakusho K. K., and after lapsing 60 seconds, the image was transferred onto a white paper, whereby a reduction in the whiteness of the transferred paper was measured.

(8) Mottling:

On a surface coated with a coating solution was printed 0.2 cc of a New GLS supergloss medium ink made by Sakata Ink K. K. by means of an RI tester made by Akira Seisakusho K. K. and after lapsing 5 seconds, further printed 0.15 cc of a New GLS red ink made by Sakata Ink K. K., whereby the ink mottling was visually evaluated.

[Criteria of evaluation]

Good: good

Fair: slightly inferior

Bad: extremely inferior (9) Curl properties:

A coating solution was applied, and after drying, the curl of the coated paper was visually evaluated.

[Criteria of evaluation]

Good: The curl was not substantially observed.

Fair: The curl was slightly observed.

Bad: The curl was severely observed.

(10) Evaporation rate:

The evaporation rate was calculated before and after the drying coated paper. The evaporation rate is expressed in terms of the amount of evaporated steam per unit area and unit time. Since in the present invention, the gas for heating used in the drying step is the same as the gas evaporated from the coated paper, the recovery and reuse are extremely easy, and the heat efficiency is high. In addition, the fact that the gas for heating is a steam enables one to shorten the pre-heating drying time as compared with the conventional method by using heated air, make the constant-rate drying temperature high, and shorten the whole drying time to thereby increase the drying rate. Accordingly, not only the productivity can be improved, but also the drying step in new chamber can be made simple.

Moreover, since the coated paper containing moisture can be rapidly heated to high temperatures, the substance to be dried is made porous, air permeability and ink absorbency are improved, and the drying rate is made fast, leading to improvements in the dimensional stability etc. of the coated paper.

While the invention has been described in detail and with reference to specific embodiments thereof, it will be apparent to one skilled in the art that various changes and modifications can be made therein without departing from the spirit and scope thereof.

What is claimed is:

1. A process for producing coated paper comprising applying an aqueous coating solution onto a paper base and drying the coated paper, wherein steam provided for drying or gas composed of steam and air of sufficient content of steam and air to maintain a wet-bulb temperature of 85° C. or higher is brought into direct contact with the coated paper, heated for regeneration, and then circulated for re-use.

2. A process for producing coated paper as claimed in claim 1, wherein said steam or said gas has a wet-bulb temperature of from 85° to 110° C.

3. A process for producing coated paper as claimed in claim 1, wherein said gas or steam heated for regeneration has a temperature of from 150° to 500° C.

4. A process for producing coated paper as claimed in claim 2, wherein said gas or steam heated for regeneration has a temperature of from 150° to 500° C.

* * * * *